US006591648B1

(12) United States Patent
Ash et al.

(10) Patent No.: US 6,591,648 B1
(45) Date of Patent: Jul. 15, 2003

(54) METHOD OF STAMPING AND PIERCING A TUBE

(75) Inventors: Stanley P. Ash, Greenville, MI (US); Dale A. Hartway, Greenville, MI (US); Theodore L. Bush, Gowen, MI (US)

(73) Assignee: Greenville Tool & Die Company, Greenville, MI (US)

( * ) Notice: Subject to any disclaimer, the term of this patent is extended or adjusted under 35 U.S.C. 154(b) by 0 days.

(21) Appl. No.: 10/178,120

(22) Filed: Jun. 24, 2002

(51) Int. Cl.[7] ..... B21D 9/15; B21D 26/02; B21D 28/28

(52) U.S. Cl. ..... 72/55; 83/54

(58) Field of Search ..... 72/55, 58; 83/53, 83/54

(56) References Cited

U.S. PATENT DOCUMENTS 3,487,668 A * 1/1970 Fuchs, Jr. ..... 72/55
4,989,482 A * 2/1991 Mason ..... 83/22
5,630,334 A 5/1997 Ash
5,666,840 A * 9/1997 Shah et al. ..... 72/55
5,737,952 A * 4/1998 Baumann et al. ..... 72/55
5,813,266 A 9/1998 Ash
5,816,089 A 10/1998 Marando
5,974,846 A * 11/1999 Ash ..... 72/55
6,006,566 A * 12/1999 Huelsberg et al. ..... 72/55
6,257,035 B1 * 7/2001 Marks et al. ..... 72/57
6,401,507 B1 6/2002 Krcek et al.

* cited by examiner

*Primary Examiner*—David Jones
(74) *Attorney, Agent, or Firm*—Warner Norcross & Judd LLP

(57) ABSTRACT

A method for piercing a tube during liquid impact forming or hydroforming to form a hole with minimal deformation in the material surrounding the hole. The method includes the steps of: (1) filling the tube with liquid; (2) stamping the tube thereby increasing the pressure of the liquid within the tube; (3) piercing the tube while the pressure is elevated with a tapered punch whereby the material around the pierced hole is pushed back toward the die wall due to the elevated internal pressure of the tube; and (4) retracting the tapered punch from the tube with the face of the punch catching on the tube wall to pull the material back toward the die wall.

17 Claims, 7 Drawing Sheets

METHOD OF STAMPING AND PIERCING A TUBE

BACKGROUND OF THE INVENTION

The present invention relates to piercing tubes, and more particularly to piercing liquid-filled metal tubes.

Two conventional methods of cold forming metal tubes to create structural members, for example, for the automotive industry, are hydroforming and liquid impact forming. In a typical hydroforming process, a tube is partially deformed by stamping it in a die. Then, internal hydraulic pressure exceeding the yield strength of the tube wall is applied to force the tube to expand and conform to the die cavity—much like blowing up a balloon. In the liquid impact forming process, a tube is filled with liquid at atmospheric pressure and sealed. The tube is stamped in a die cavity. During stamping, the liquid resists the compressive forces generated and forces the tube walls to correspond to the configuration of the die cavity.

After either the hydroforming process or the liquid impact forming process, holes are typically pierced or punched into the structural tube, for example, to provide points of attachment. Typically, punching holes deforms the metal surrounding the hole. The material surrounding the holes typically is crater-shaped around the punched hole. As depicted in FIG. 1 the tube 4 is pierced by a punch 110 to form a slug 112 and define a hole 114. Because tube wall 10 is not backed up during the punch process, tube wall 10 deforms the material 116 in the area surrounding the hole 114 and the punch 110.

In one attempt to reduce deformation surrounding the hole, the tube is "pre-bulged" in the area where the hole is to be pierced. The outwardly bulged material is depressed and substantially flattened during punching of the hole. This technique is disclosed in U.S. Pat. No. 5,813,266 issued Sep. 29, 1988, to Ash. As a result, the pierced tube has less deformation surrounding the hole than a comparative tube pierced without an outwardly bulged area. While reducing deformation, this process requires the additional formation of a bulge in the metal tube around punched holes, thereby adding another step to the tube forming process and increasing the cost of stamping.

SUMMARY OF THE INVENTION

The aforementioned problems are overcome in the present invention wherein a liquid-filled tube is pierced with a tapered punch during stamping to form a hole with minimal deformation of material surrounding the hole. More specifically, a preferred process of liquid impact forming or hydroforming, and piercing a tube includes the following steps. First, a sealed liquid-filled tube is positioned within a die cavity. Second, the tube is stamped causing the internal pressure of the liquid in the tube to be boosted due to the compressive force of the stamping so that the exterior of the tube conforms to the interior of the die cavity. Third, a tapered punch in the die cavity pierces through a tube wall. Due to the elevated internal pressure of the tube, the deformed material adjacent the punched hole is pushed back against the die wall. The tapered punch permits the free movement of the material to its pre-punch position. Finally, the tapered punch is retracted from the die cavity. During retraction, the relatively large end of the tapered punch catches on the material adjacent the hole pulls the material back against the die wall.

The present invention provides an efficient and economical process to pierce stamped tubes and create clean, well-defined holes in the tubes without the need for additional machining.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
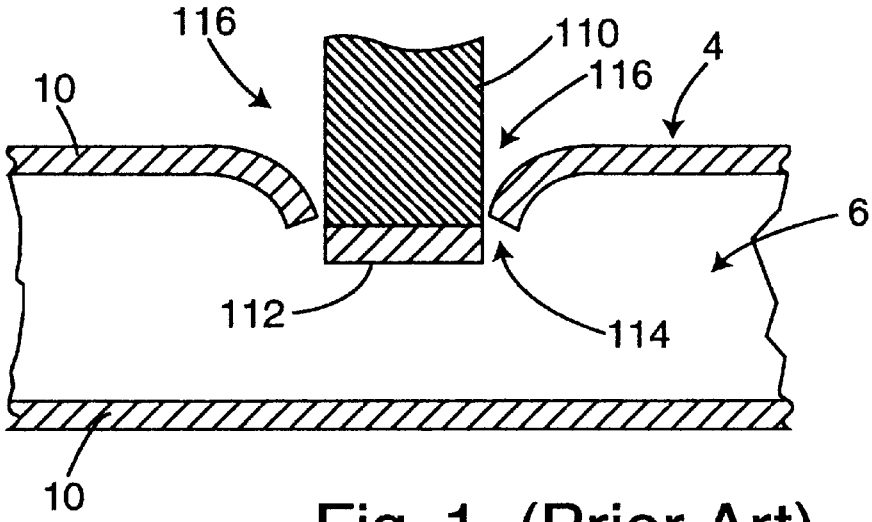
Fig. 1 (Prior Art)
FIG. 1 is a sectional view of a prior art method wherein a tube is pierced by a punch to form a hole.
Figure 2:
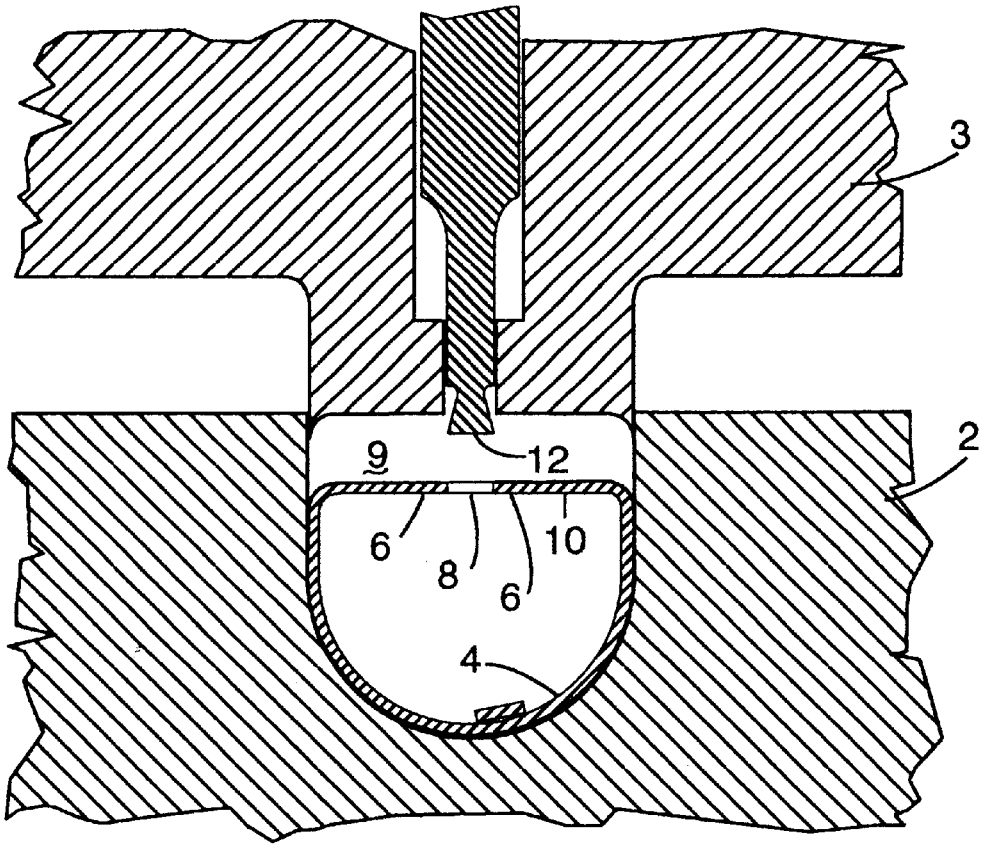
FIG. 2 is a sectional view of a tube and press according to the method of the present invention after the piercing.

A pierced tube manufactured in accordance with preferred embodiment of the present invention is illustrated in FIG. 2 and generally designated 4. FIG. 2 depicts the tube after it has been pierced. The pierced tube includes a wall portion 10 defining a hole 8. Around the hole 8 is material 6 which is pushed back substantially flush with the wall portion 10. The pierced tube is illustrated after having been stamped between upper 3 and lower 2 dies. Tapered punch 12 corresponds to the hole 8, as the tapered punch made the hole. The punch 12 is tapered along the longitudinal axis thereof. Alternatively, the punch may be configured so that its face is larger than the remainder of the punch. The cross section of the punch may be a variety of shapes including, but not limited to circular, oval, square, rectangular, and others as will be appreciated by those skilled in the art.

FIG. 2 also shows a cross section of the die. Die sections 2 and 3 form die cavity 9. While the die cavity 9 of FIG. 2 is shown having a semicircular cross sectional shape, the die cavity could have other non-cylindrical or polygonal cross-sectional shapes to form other die cavity interior configurations, as will be appreciated by those skilled in the field.

Method of Preparation

A preferred process of piercing a tube wherein the material in the area of the tube defining the hole has minimal deformation generally includes: sealing liquid at atmospheric pressure within a tube; stamping the tube in a liquid impact die; piercing a wall of the tube within the closed stamping die with a tapered punch whereby the internal pressure of the tube forces deformed material around the pierced hole to be pushed back against the wall of the tube adjacent the hole; and retracting the tapered punch from the hole whereby the tapered punch pulls the material around the hole back against the die. Accordingly, a well-defined hole is formed.

Figure 3:
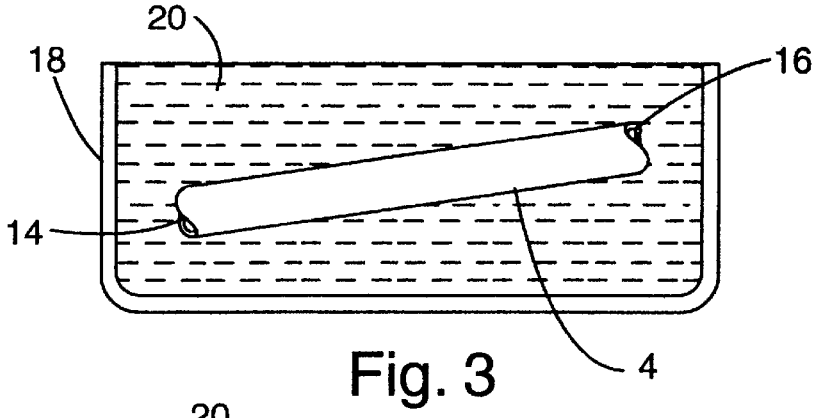
FIG. 3 is a side view of a tube submerged in liquid.

In a liquid impact forming process, to create a pierced tube having minimal deformation around the hole from piercing, the tube must be filled with a liquid at approximately atmospheric pressure prior to stamping the tube in a liquid impacting die. One inexpensive, readily available liquid is water. If desired, additives such as lubricants, bactericides, or rust preventatives can be added to the liquid as is known in the art. FIG. 3 shows the preferred method for filling a tube with liquid. Tube 4 has open ends 14 and 16, and a given interior volume (not shown). Tube 4 is submerged in a tub or basin 18 containing liquid 20. Open end 16 is elevated relative to open end 14, so that as the air that is in the interior volume of the tube exits through elevated open end 16, the interior volume of the tube fills with liquid 20 entering through open end 14.

Figure 4:
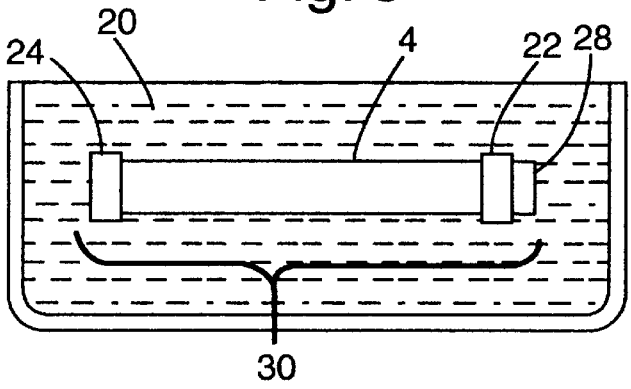
FIG. 4 is a side view of a liquid-filled sealed tube submerged in liquid.

Referring to FIG. 4, once tube 4 is filled with a liquid, the tube is sealed. A preferred method of sealing tube 4 is by attaching caps 22 and 24 to the ends of the tube 4 while the tube remains submerged, thus enclosing liquid 20 within tube 4. The caps must be attached to form a seal that can withstand the elevated pressures to which the tube will be subjected to later in the stamping process. Methods of attaching a cap to the end of the tube to form a pressure-tight seal are known in the art.

After attachment of the caps 22 and 24 to the tube, the interior of the tube 4 is sealed or enclosed to form sealed tube 30, which is full of liquid 20 at approximately atmospheric pressure. Preferably, caps 22 and 24 are backed up or held in place by die sections (not shown) to prevent caps 22 and 24 from moving or sliding off the end of the tube when the pressure within the tube increases during the stamping operation.

Figure 5:
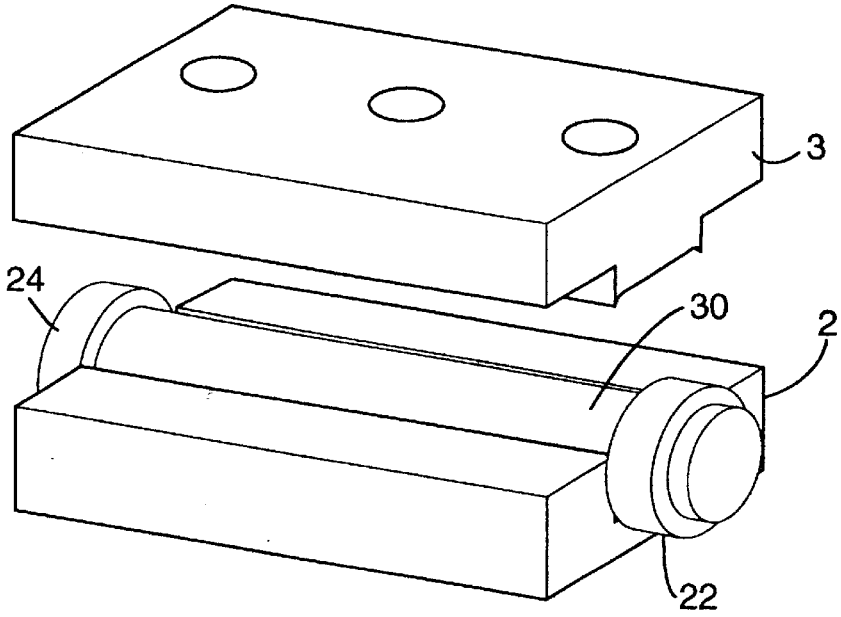
FIG. 5 is a perspective view of the liquid-filled sealed tube in an open die.
Figure 6:
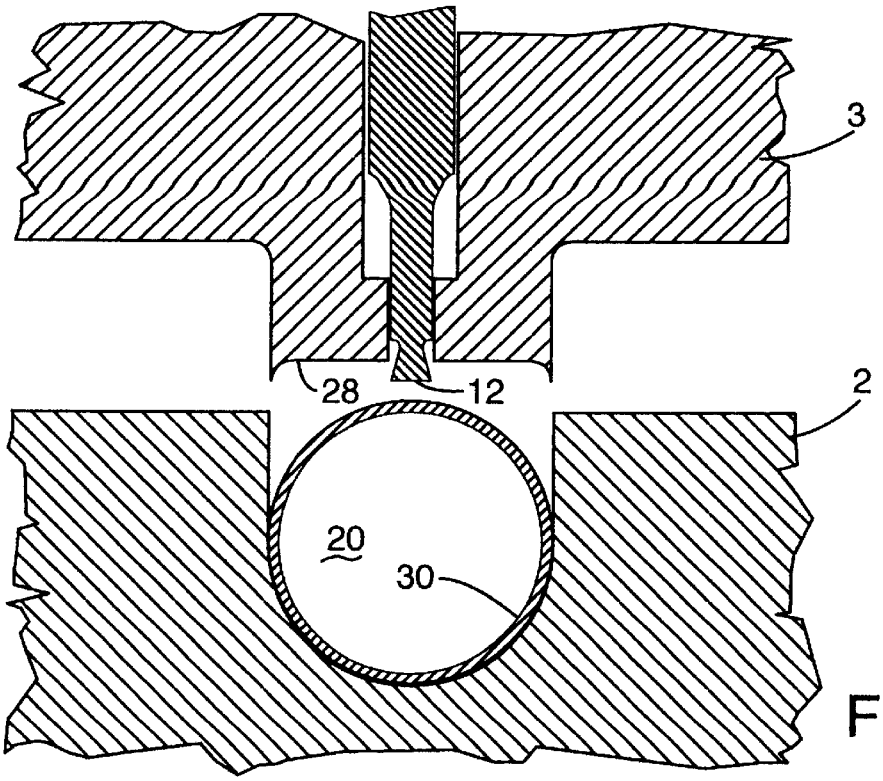
FIG. 6 is a sectional view of the tube and die before the tube is stamped.

Referring to FIGS. 5 and 6, sealed tube 30, which is filled with a liquid at approximate atmospheric pressure, is positioned in lower die section 2 prior to the closure or mating of upper die section 3 with lower die section 2. While FIG. 5 shows a die that has upper 3 and lower 2 die sections, the method of the present invention can be used with a die that contains more than two die sections, for example a die that also contains side wall die sections, or with die sections that close horizontally rather than vertically. Gas springs (not shown) can be built into the die mold along with cam steels (not shown) to give added control during the cold forming process.

FIG. 6 illustrates a sectional view of the tube prior to stamping according to the preferred method. The tube 30 is placed between die sections 2 and 3. Tapered punch 12 protrudes from upper die wall 28 of the upper die section 3.

Figure 7:
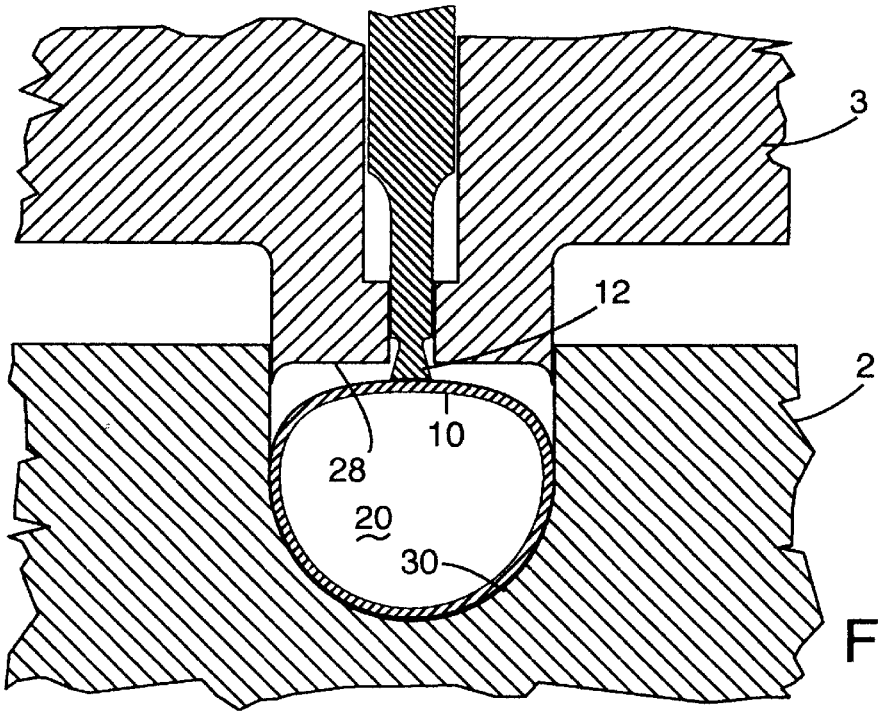
FIG. 7 is a sectional view of the tube and die being initially engaged.

FIG. 7 depicts the initiation of the stamping process. Upper die section 3 descends toward lower die section 2. The compressive forces generated as the die closes to stamp sealed tube 30 also act to compress the liquid 20 within the interior of the tube as it changes shape. As the liquid resists compression, it forces the tube 30 outwardly against the interior surface of the die cavity 9. The wall portion 10 is accordingly pressed against the tapered punch 12.

Figure 8:
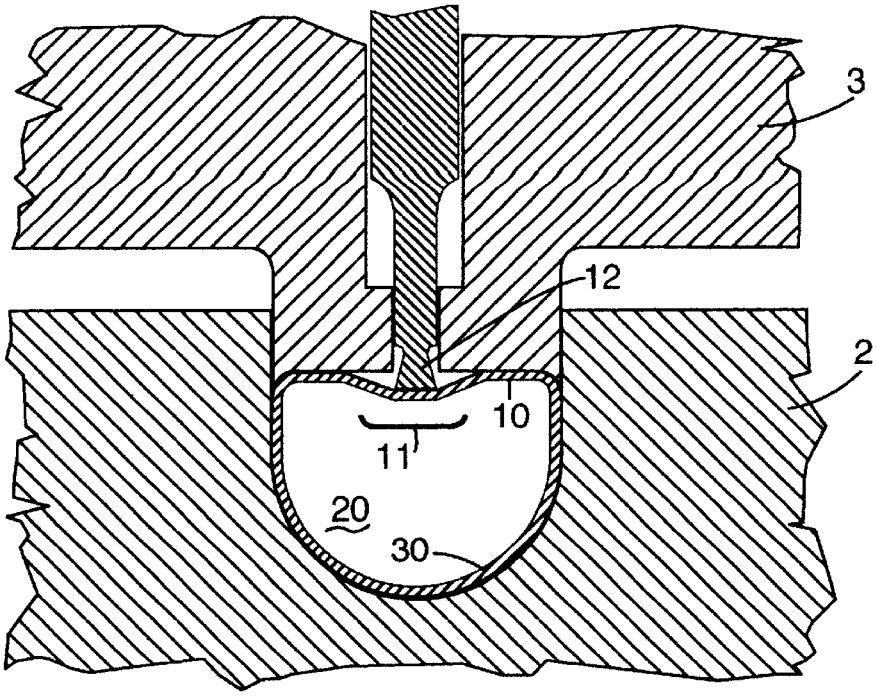
FIG. 8 is a sectional view of the tube and die after stamping the tube and before piercing the tube.

FIG. 8 depicts the tube 30 as the upper die 3 continues to descend. The punch 12 has substantially deformed wall portion 10 so that a bulge 11 is formed on the interior of the tube. At this point, the hydraulic pressure of the liquid 20 of the interior of the tube has been elevated substantially above atmospheric pressure due to the compression of the tube within the die. As will be appreciated by those skilled in the art, the forces generated by the hydraulic pressure are almost equal to that of the yield strength of the tube wall. Depending on the type of material used to make the tube, as well at the desired configuration of the tube, the precise hydraulic pressure necessary to exceed the yield strength of the wall may be calculated, as will be appreciated by those skilled in the art.

Figure 9:
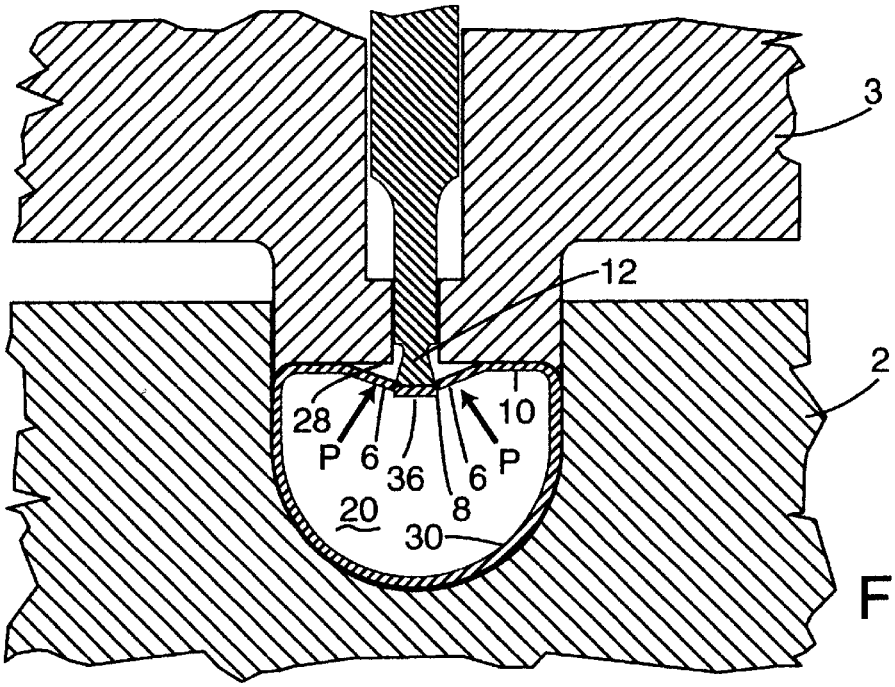
FIG. 9 is a sectional view of the tube and die immediately after piercing the tube.

Next, as depicted in FIG. 9, due to further compression between the dies 2 and 3, the internal pressure of the liquid 20 on the interior of the tube 30 is increased above the pressure necessary to generate forces in excess of the yield strength of the wall 10. Accordingly, this pressure causes tapered punch 12 to cut through the bulge 11 to define hole 8 and form slug 36. The material 6 around the hole. 8 stretches toward the center of the hole and projects inward due to the piercing action of the punch 12. The internal pressure P of the liquid 20 simultaneously causes deformed material 6 to be forced outward against upper die wall 28.

Figure 10:
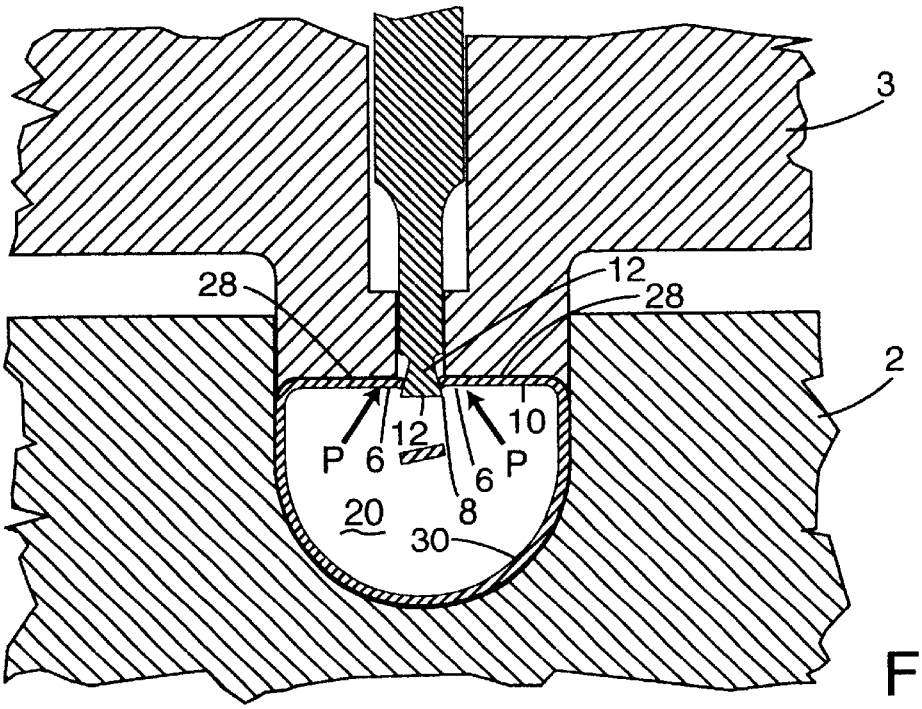
FIG. 10 is a sectional view of the tube and die after the tube has been fully pierced.
Figure 10A:
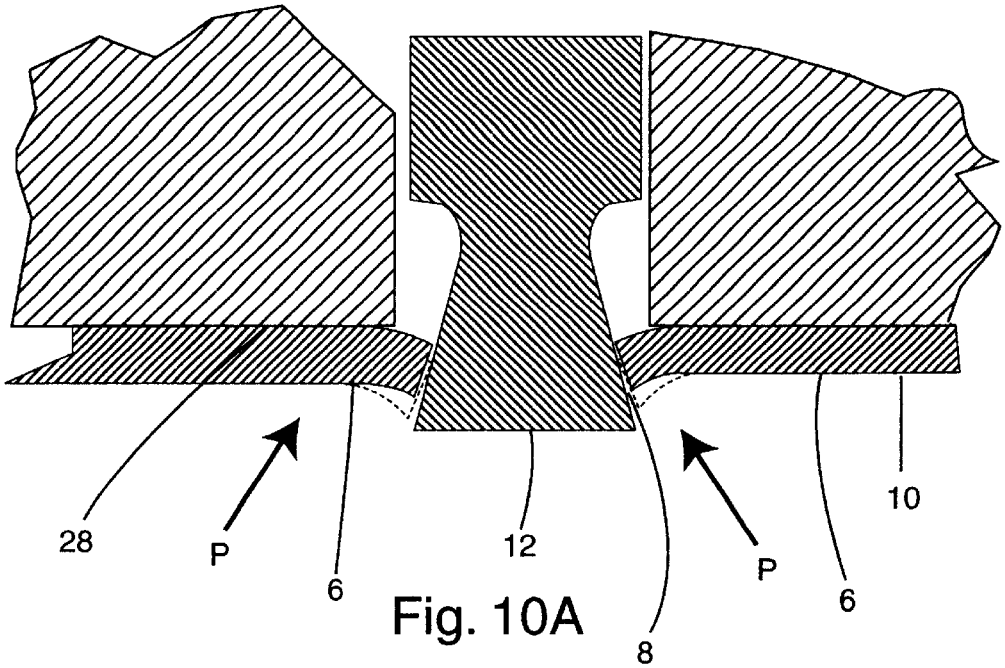
FIG. 10A is an enlarged sectional view of the tube and die after the tube has been fully pierced.

As illustrated in FIGS. 10 and 10*a*, the elevated internal pressure P of the tube 30 continues to push the material surrounding the hole 8 against die wall 28. Given the taper of the punch 12, the forcing of the material around the hole against the die wall 28 is not inhibited by the punch itself. With particular; reference to FIG. 10*a*, the material around the hole 8 is shown in broken lines in a very stretched state, projecting into the pathway of the enlarged portion of the punch 6. After the elevated internal pressure P has acted on the stretched material, the stretched material pushes outward against the die wall 28, thus closing in more around the punch as depicted in solid lines. Unlike the prior art cylindrical punches, as the material 6 travels outward to ward the die wall 28, it does not fold down against the tapered punch. Once the deformed material 6 around the hole 8 has been substantially reformed against the die wall 28, the tapered punch 12 is retracted.

Figure 11:
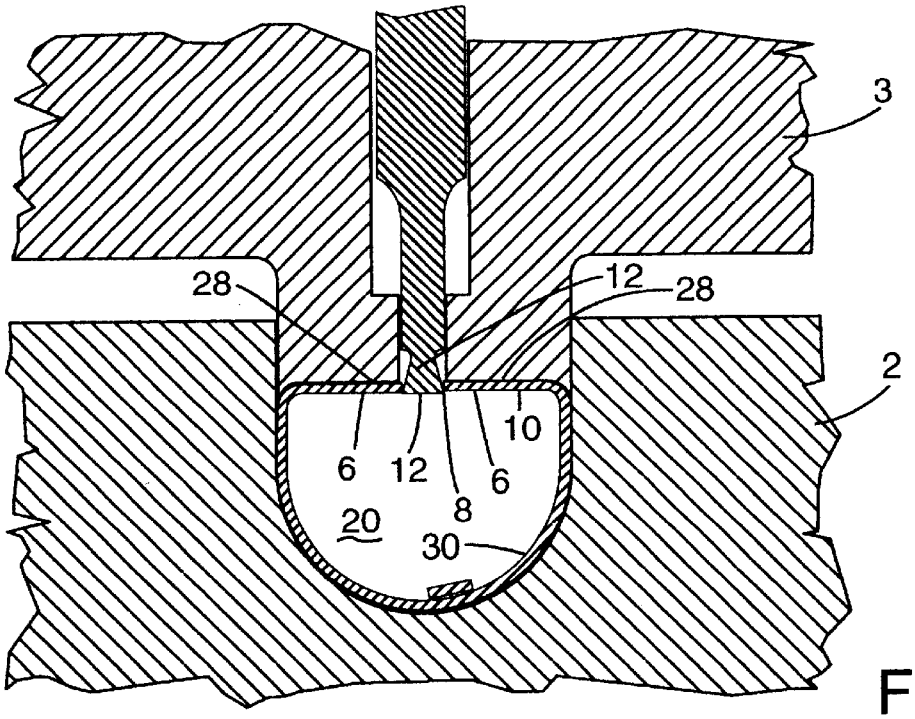
FIG. 11 is a sectional view of the tube and die as the tapered punch is retracted.
Figure 11A:
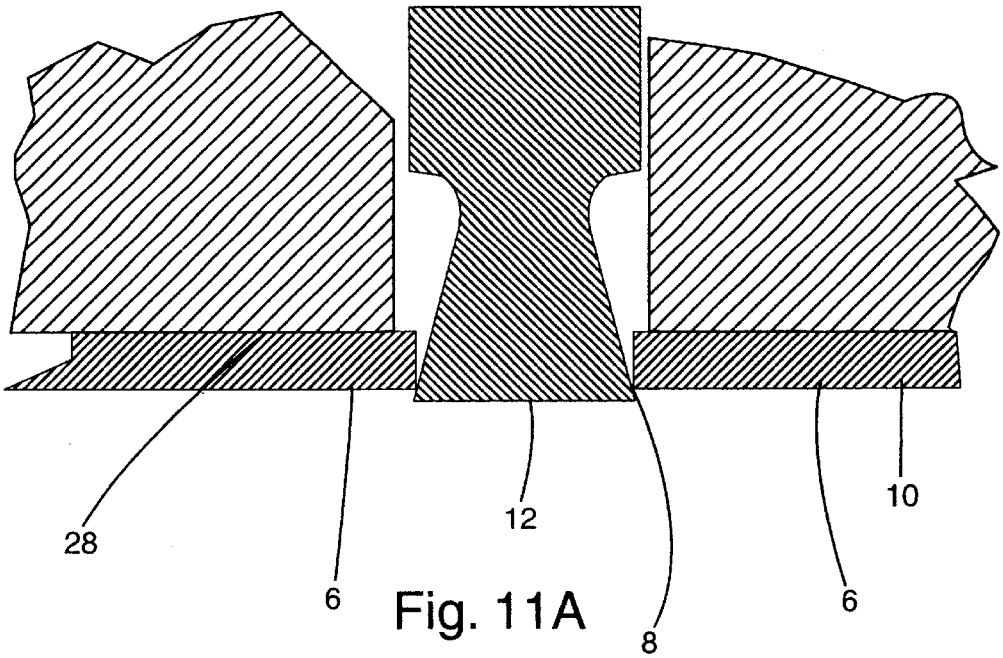
FIG. 11A is an enlarged sectional view of the tube and die as the tapered punch is retracted.

FIGS. 11 and 11*a* depict the retraction of the tapered punch out through the hole 8. During retraction, the stretched material 6 surrounding the hole 8 and projecting into the path of the tapered punch 12 is pulled outward against upper die wall 28 by the tapered punch 12.

Figure 12:
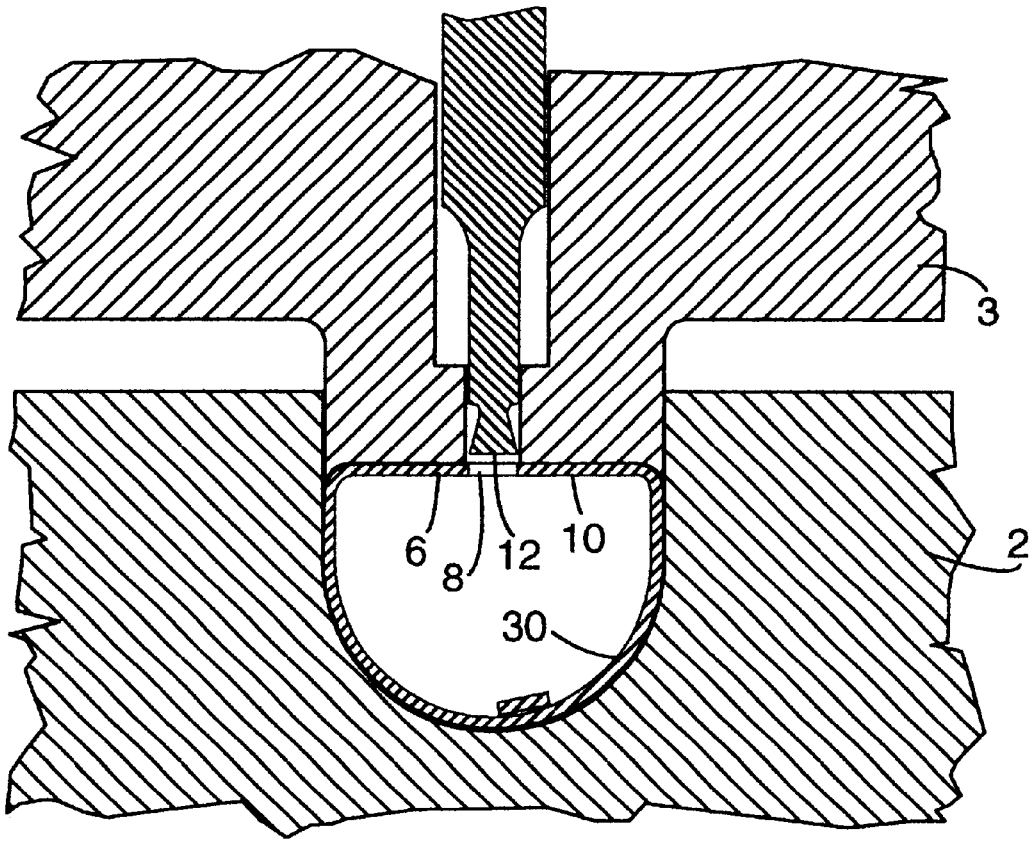
FIG. 12 is a sectional view of the tube after the tapered punch has been fully retracted.

As illustrated in FIG. 12, the material 6 surrounding the hole 8 is substantially flush with the wall portion 10 of tube 30. After the tube 30 has been pierced and the punch 12 retracted, the upper and lower die sections 3 and 2 are separated to release the stamped and pierced tube 30. The end caps 22 and 24 (FIG. 5) are removed. The tube ends are finished using methods that are known in the art.

Alternative Method of Preparation

Alternative methods of piercing a tube having minimal deformation around pierced holes may be conducted using hydroforming techniques, in conjunction with the preferred process described above as will be appreciated by those skilled in the art.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A process of forming a pierced tube comprising the steps of:

providing a die having a die cavity of a given interior configuration to form a stamped tube having an exterior configuration conforming to the interior configuration of the die cavity;

placing a liquid-filled tube within the die cavity;

increasing the pressure within the tube to force the tube to conform to the interior configuration of the die cavity; and piercing the tube with a tapered punch while the pressure is above static pressure wherein the punch includes a first portion that extends into the tube when piercing the tube, the first portion terminating at a punch face, the cross section of the punch face being larger than the cross section of the remainder of the first portion.

2. The process of claim 1 wherein said piercing step causes material surrounding the hole to partially project into the die cavity.

3. The process of claim 2 wherein the pressure increasing step forms the material surrounding the hole to press against the interior configuration of the die cavity.

4. The process of claim 3 further comprising the step of retracting the tapered punch from said tube, whereby the punch withdraws the projected material to bring it substantially flush with the exterior configuration of the tube.

5. The process of claim 1 wherein said pressure increasing step is caused by liquid impact forming the tube.

6. The process of claim 1 wherein said pressure increasing step is caused by hydroforming the tube.

7. A process for piercing a tube comprising the steps of:

filling a tube with a liquid;

increasing the internal pressure of the liquid within the tube;

piercing the tube with a punch that terminates at a punch face and includes a cross section that increases toward the punch face; and withdrawing the punch from the tube so that the punch catches and pulls on the tube.

8. The process of claim 7 wherein said piercing step creates deformed material surrounding the hole.

9. The process of claim 8 further comprising the step of withdrawing the tapered punch from the hole whereby the deformed material surrounding the hole is retracted to substantially conform to the exterior configuration of the tube.

10. The method of claim 9 wherein the internal pressure of the tube is maintained to force the deformed material around the hole toward the exterior configuration of the tube so that the material around the hole is forced flush with the exterior configuration.

11. The process of claim 10 wherein the liquid is sealed in the tube with a pair of end caps on opposite sides of the tube.

12. The process of claim 11 wherein the die holds the end caps on the opposite ends of the tube during said internal pressure increasing step.

13. A method of piercing a metal tube comprising:

filling a tube with liquid;

stamping the liquid-filled tube in a die thereby elevating the pressure of the liquid within the tube above atmospheric pressure;

piercing the tube while the pressure is elevated with a punch, whereby any deformed material is pushed back toward the die by the pressurized liquid including a first portion having a punch face and an outer diameter, the first portion and punch face penetrating the tube during piercing, the outer diameter increasing in size along the first portion toward the punch face; and retracting the punch from the pierced tube.

14. The method of claim 13 wherein the tube includes a sealed interior.

15. The method of claim 14 further comprising the step of increasing the pressure of the tube interior to a predetermined pressure.

16. The method of claim 15 wherein the predetermined pressure is capable of reforming any deformations of the material so that the material is flush with the exterior surface of the tube.

17. The process of forming a pierced tube comprising the steps of:

providing a die cavity having a punch projecting into the cavity, said punch including a piercing portion that terminates at a punch face and includes a remainder, the punch face and the remainder adapted to enter a tube placed in the die cavity the punch face being greater in cross-sectional area than any portion of the remainder;

placing a tube within the die cavity;

stamping the tube in the die cavity;

piercing the tube with the punch to define a hole in the tube whereby material around the hole is deformed; and withdrawing the punch from the tube.

* * * * *